US009151528B2

(12) United States Patent
Erbs et al.

(10) Patent No.: US 9,151,528 B2
(45) Date of Patent: Oct. 6, 2015

(54) SANITATION SYSTEM AND METHOD FOR ICE STORAGE AND DISPENSING EQUIPMENT

(75) Inventors: Daryl G. Erbs, Sheboygan, WI (US); Lee F. Wichlacz, Two Rivers, WI (US); Brian G. Polly, Manitowoc, WI (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 0 days.

(21) Appl. No.: 13/572,603

(22) Filed: Aug. 10, 2012

(65) Prior Publication Data

US 2013/0039808 A1 Feb. 14, 2013

Related U.S. Application Data

(60) Provisional application No. 61/523,037, filed on Aug. 12, 2011.

(51) Int. Cl.
*A61L 2/20* (2006.01)
*F25C 5/18* (2006.01)

(52) U.S. Cl.
CPC ..... *F25C 5/18* (2013.01); *F25C 2400/12* (2013.01); *Y10T 29/49826* (2015.01)

(58) Field of Classification Search
CPC ..... F25C 5/00; F25C 5/002; F25C 5/007; A61L 2/202
USPC ..... 422/28, 29
See application file for complete search history.

(56) References Cited

U.S. PATENT DOCUMENTS

| | | | | |
|---|---|---|---|---|
| 4,252,002 | A * | 2/1981 | Mullins, Jr. | 62/344 |
| 6,167,711 | B1 | 1/2001 | Slattery et al. | |
| 6,596,233 | B2 | 7/2003 | Berge et al. | |
| 6,939,397 | B2 | 9/2005 | Nelsen et al. | |
| 7,726,148 | B2 | 6/2010 | Martin et al. | |
| 2008/0287924 | A1 * | 11/2008 | Mangiardi | 606/1 |
| 2009/0142225 | A1 | 6/2009 | Tornqvist | |

OTHER PUBLICATIONS

International Search Report and Written Opinion dated Oct. 26, 2012 from corresponding International Patent Application No. PCT/US2012/050478, 11 pages.
International Preliminary Report on Patentability dated Jul. 26, 2013 corresponding to PCT/US12/50478, 7pp.

* cited by examiner

*Primary Examiner* — Sean E Conley
*Assistant Examiner* — Donald Spamer
(74) *Attorney, Agent, or Firm* — Ohlandt, Greeley, Ruggiero & Perle, LLP

(57) ABSTRACT

A system and methods for sanitation of ice storage equipment. An ozone generator provides a sanitizing agent comprised of a mixture of ambient air and ozone. The sanitizing agent is circulated through an ice storage bin. The sanitizing agent cleanses interior surfaces of the ice storage bin and also cleanses surfaces of an ice dispenser that dispenses ice from the ice storage bin.

13 Claims, 3 Drawing Sheets

SANITATION SYSTEM AND METHOD FOR ICE STORAGE AND DISPENSING EQUIPMENT

RELATED APPLICATION

This application claims the priority of U.S. Provisional Application Ser. No. 61/523,037, filed on Aug. 12, 2011, the entire contents of which are hereby incorporated herein.

FIELD OF THE DISCLOSURE

This disclosure relates to a system and method for sanitation of ice storage and dispensing equipment.

BACKGROUND OF THE DISCLOSURE

A self-contained ice machine with dispenser provides a convenient source of ice (and typically water) for dispensing into cups or serving containers. These machines are commonly used in healthcare facilities to serve ice and water to patients.

Sanitation of the ice producing evaporator, ice storage bin, and dispensing mechanism typically requires manual application of a sanitizing solution to these components. Since all of the ice must be emptied from the bin and partial disassembly of the machine is required to access the interior of the bin, the frequency of sanitation is often on the order of weeks or months. Microorganisms can be introduced into the storage bin through gaps in the joints of the bin, the dispensing outlet, and through the ice produced by the evaporator, causing loss of sanitation during the periods between sanitizing.

Thus, there is a need for a system and method of cleaning an ice storage and dispenser equipment without disassembly.

SUMMARY OF THE DISCLOSURE

An embodiment of a sanitation system for ice storage equipment according to the present disclosure comprises an ice storage bin comprising an ice receiving inlet, an airflow inlet and an airflow outlet. An ozone generator, which is in fluid communication with the ice storage bin, circulates a sanitizing agent through the ice storage bin via the airflow inlet and the airflow outlet. The sanitizing agent comprises a mixture of ozone and air that sanitizes one or more interior surfaces of the ice storage bin and of any ice disposed within the ice storage bin.

In another embodiment of the sanitation system of the present disclosure, a supply duct connects the ozone generator to the airflow inlet and a return duct connects the airflow outlet to the ozone generator. The sanitizing agent circulates through the ice storage bin via the supply duct and the return duct.

In another embodiment of the sanitation system of the present disclosure, a mixing Tee has an outlet connected to the ozone generator, a first inlet connected to the return duct and a second inlet connected to ambient. First and second orifices are associated with the first and second inlets, respectively, and wherein the orifices are sized to control flow rates in the first and second inlets so as to develop a positive pressure level within the ice storage bin.

In another embodiment of the sanitation system of the present disclosure, an ice dispenser is disposed within the ice storage bin and comprises a nozzle disposed to dispense ice via an ice exit of the ice storage bin. A vent is disposed in the ice storage bin to allow a small portion of the sanitizing agent to flow through the gap to sanitize surfaces of the ice dispenser and of the ice exit.

In another embodiment of the sanitation system of the present disclosure, one or more seals are disposed to prevent leakage of the sanitizing agent from the ice storage bin except for the vent.

In another embodiment of the sanitation system of the present disclosure, the airflow outlet is located above the airflow inlet.

In another embodiment of the sanitation system of the present disclosure, the airflow outlet is located on a top of the ice storage bin and the airflow inlet is located on a side of the ice storage bin to direct a flow of the sanitizing agent from a bottom to a top of the ice storage bin to purge and replace non-ozone air within the ice storage bin with the sanitizing agent.

In another embodiment of the sanitation system of the present disclosure, an ice making machine provides ice to the ice receiving inlet.

An embodiment of a method for sanitizing ice storage and dispensing equipment according to the present disclosure comprises:

circulating a sanitizing agent through an ice storage bin, wherein the sanitizing agent comprises a mixture of ozone and air that sanitizes one or more interior surfaces of the ice storage bin; and directing a flow of the sanitizing agent from a bottom to a top of the ice storage bin to purge and replace non-ozone air within the ice storage bin with the sanitizing agent.

In another embodiment of the method for sanitizing ice storage and dispensing equipment according to the present disclosure the method further comprises:

developing a positive pressure within the ice storage bin; and directing a small portion of the flow of the sanitizing agent through a vent to sanitize ice dispensing components of an ice dispenser that dispenses ice from the ice storage bin.

In another embodiment of the method for sanitizing ice storage and dispensing equipment according to the present disclosure the flow of the sanitizing agent comprises a laminar flow of ozone containing air.

An embodiment of a method for assembling ice storage equipment according to the present disclosure comprises:

connecting an output of an ozone generator to an inlet of an ice storage bin with a first duct;

connecting an output of a mixing Tee to an input of the ozone generator; and connecting an outlet of the ice storage bin to an input of the mixing Tee.

BRIEF DESCRIPTION OF THE DRAWINGS

Other and further objects, advantages and features of the present disclosure will be understood by reference to the following specification in conjunction with the accompanying drawings, in which like reference characters denote like elements of structure and.

DESCRIPTION OF THE PREFERRED EMBODIMENT

Figure 1:
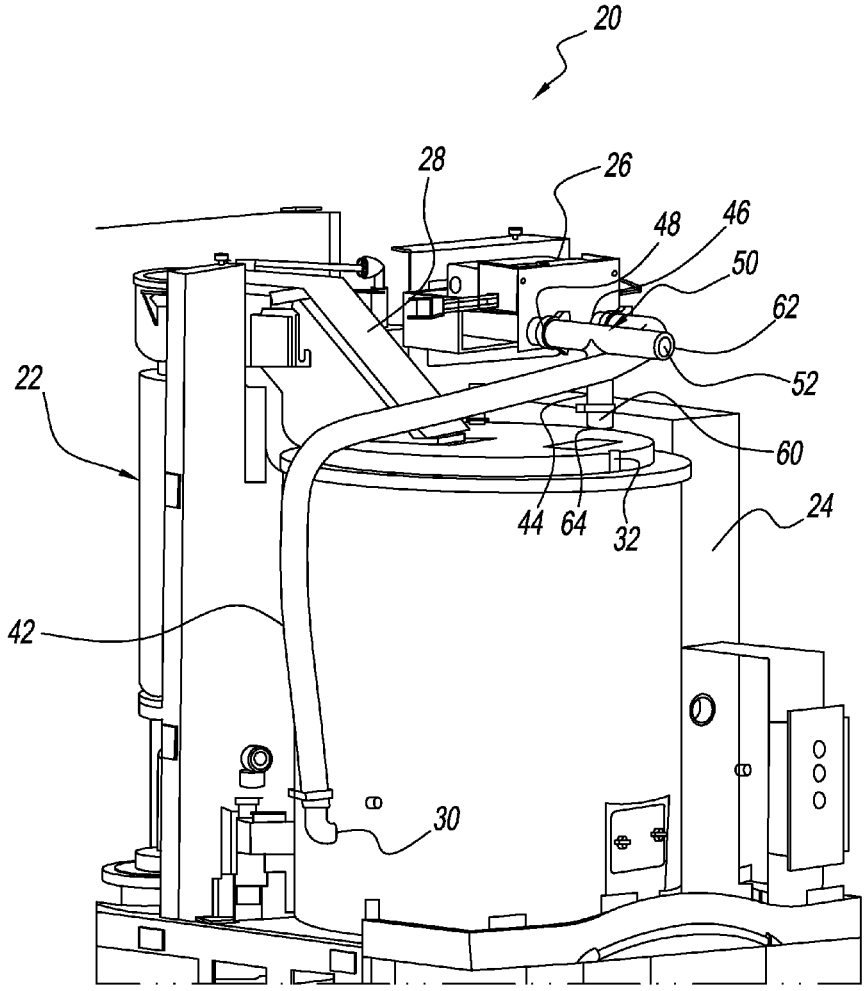
FIG. 1 is a perspective view of a system and for sanitation of ice storage and dispensing equipment according to the present disclosure.
Figure 2:
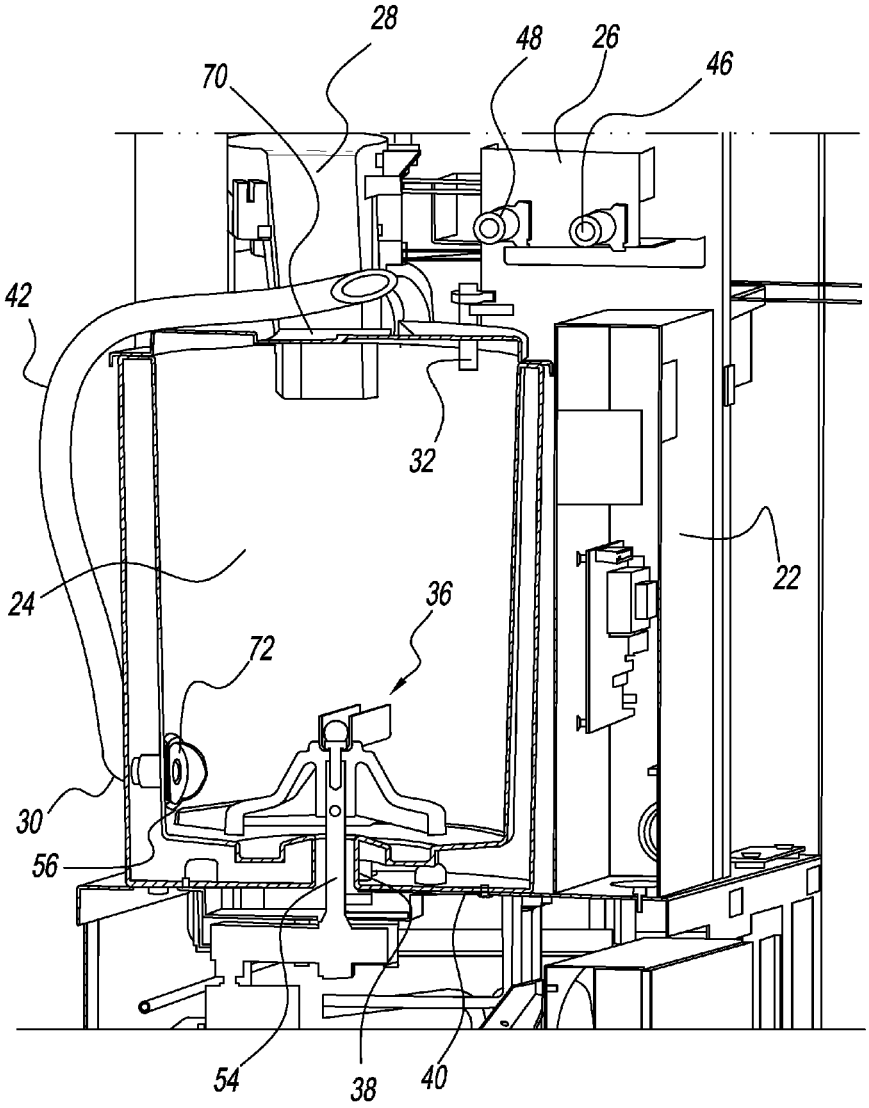
FIG. 2 is a cross-sectional view of FIG. 1.

Referring to FIGS. 1 and 2, a system 20 of the present disclosure comprises an ice making apparatus 22, an ice storage bin 24, an ozone generator 26 and an ice dispenser 36 (shown in FIG. 2). Ice making apparatus 22 may be any apparatus that makes ice pieces. The ice pieces may have any desired shape such as cubes, nuggets, lumps, cylinders and the like. By way of example, ice making apparatus 22 is shown as an auger type ice making machine. A conveyance 28 is disposed to convey ice from ice making apparatus 22 to ice bin 24.

Ice storage bin 24 comprises an airflow inlet 30, an airflow outlet 32, an ice inlet 34 and an ice exit 38. Ice inlet 34 is connected to conveyance 28. Ice exit 38 is disposed at a location toward a bottom 40 of ice storage bin 24. Preferably, ice exit 38 is disposed near airflow inlet 30. In the embodiment shown in FIGS. 1-3, ice exit 38 is disposed in bottom 40 of ice storage bin 24. A supply duct 42 connects airflow inlet 30 to an output 46 of ozone generator 26. A return duct 44 connects airflow outlet 32 to an input 48 of ozone generator 26 by way of a mixing Tee duct 50. Mixing Tee duct 50 has two inlets 60 and 62. Inlet 60 is connected to return duct 44 and inlet 62 is arranged to receive a flow of ambient air. An orifice 52 is disposed in inlet 62. An orifice 64 is disposed in inlet 60 or in return duct 44. Orifices 52 and 64 are sized to control relative airflow rates in inlets 62 and 60 so as to achieve an inflow of ambient air within a desired range of a percentage of the overall flow rate for ozone generator 26, and also to develop a positive pressure level within ice storage bin 24 that achieves a desired rate of outflow via a vent 56 to sanitize ice dispensing surfaces of ice dispenser 36.

Supply duct 42, return duct 44 and mixing Tee duct 50 may be constructed of any suitable material for conveying a gas. For example, the material may be silicone rubber.

Ice dispenser 36 is situated at a location near airflow inlet 30 of ice storage bin, e.g., near or at bottom 40. Ice dispenser 36 comprises a nozzle 54 disposed in ice exit 38. The outflow of ozone and ambient air from gap 56 continuously sanitizes surfaces of nozzle 54 and ice exit 38.

Ozone generator 26 may be any ozone generator that adds a small amount of ozone to ambient air taken in via orifice 52 to provide a sanitizing agent composed of a mixture of ozone and other ions and ambient air to supply duct 42 via output 46. Ozone generator 26, for example, is available from Biozone Scientific International.

The sanitizing agent is formed by passing ambient air and ionized return air from return duct 44 through a source of energy of sufficient potential. The sanitizing agent is circulated by a fan through ice storage bin 24. The ionized air is introduced into ice storage bin 24 via airflow inlet 30, which is near bottom 40. Return duct 44 is situated at a top of ice storage bin 24, which ensures that the entire volume of ice and all internal food zone surfaces of ice storage bin 24 and ice dispenser 36 are exposed to the ionized air. This is due to the fact that ionized air is heavier than normal air, and the velocity of the ionized air through ice storage bin 24 is maintained very low, allowing laminar displacement of all ambient air from ice storage bin 24 by the ionized air.

Ozone generator 26 produces ionized air such that the concentration of ozone and other ions is sufficient to ensure effective sterilization of the ice and ice storage bin 24, but below the concentration level that would create any harmful effects to the users of the system or the materials used to construct ice storage bin 24 and ice dispenser 36.

Ice storage bin 24 is sealed with a set of seals with the exception of vent 56 at ice exit 38 at bottom 40 where ice dispenser 36 releases ice through nozzle 54, which is designed to direct the ice into a cup or other container. Vent 56 allows a small flow of ionized air to continuously sanitize ice dispenser 36 and nozzle 54. The set of seals is disposed to mating surfaces of ice storage bin 24 to control leakage of the ionized air between the inside and outside of ice storage bin 24. Two of the seals are shown in FIG. 2, namely a seal 70 that seals a top of ice storage bin to conveyance 28 and a seal 72 that seals airflow inlet 30 to supply duct 42. Other seals (not shown) seal airflow outlet 32 to return duct 44 and dispenser 36 to bottom 40, except for vent 56, which may be formed as a hole in a seal.

Flow orifices 52 and 64 provide regulation of both the positive pressure within the foodzone volume and the volumetric flow rate available for the controlled leak path used to sanitize the spout of ice dispenser 36. The use of heavier than air ozone as a sanitizing agent, combined with the physical location of the airflow inlet 30 and the airflow outlet 32, ensures complete displacement of ambient air that does not contain ozone (non-ozone air) during operation of the sanitizing system.

A method of the present disclosure maintains sanitary ice in ice storage bin 24 and ice dispenser 36. A laminar flow of ozone containing air through a volume of ice in ice storage bin 24 is provided at a rate that ensures the concentration of ozone is within a range necessary to ensure efficacy for the entire volume of ice. A flow direction of the ozone laminar flow is controlled from bottom 40 to a top of ice storage bin 24 to ensure that all air in ice storage bin 24 is purged and replaced by ozone containing air. A positive pressure is developed in ice storage bin 24 and other food zone volumes (such as conveyance 28 and food zones of ice making apparatus 22) to ensure that any minor leakage paths in the seals for the boundary elements result in leakage of disinfected air to the outside. The positive pressure and a controlled leak path at ice exit 38 directs a small flow of ozone containing air over the inside surfaces of a dispensing spout of ice dispenser 36 to continuously sanitize those surfaces that contact ice during a dispense operation.

Another method of the present disclosure assembles system 20. This method comprises:

connecting output 46 of ozone generator 26 to airflow inlet 30 of ice storage bin 24 with supply duct 42;

connecting an output of mixing Tee 50 to an input 48 of ozone generator 26; and connecting airflow outlet 32 of ice storage bin 24 to an input of mixing Tee 50 with return duct 44.

Figure 3:
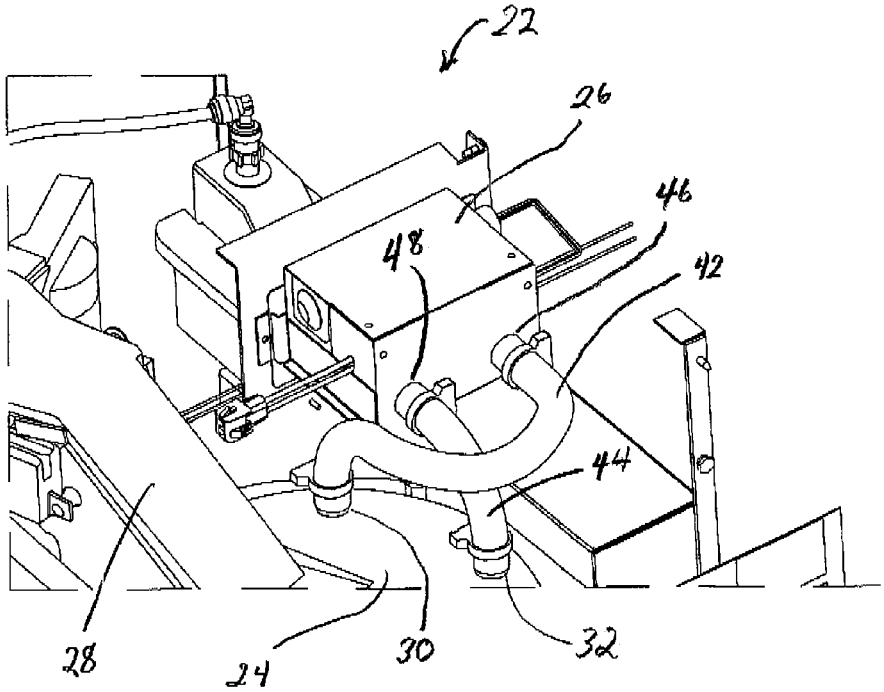
FIG. 3 is a perspective view of another embodiment of a system for sanitation of ice storage and dispensing equipment according to the present disclosure.

Referring to FIG. 3, in an alternate embodiment of the system of the present disclosure, the airflow inlet 48 and outlet 46 are both located on a top of the ice storage bin 24.

The present disclosure having been thus described with particular reference to the preferred forms thereof, it will be obvious that various changes and modifications may be made therein without departing from the scope of the present disclosure as defined in the appended claims.

What is claimed is:

1. A sanitation system for ice storage equipment comprising:

an ice storage bin comprising a top, a bottom and at least one sidewall, wherein said top is a surface disposed in substantially parallel relationship to said bottom and wherein said sidewall is disposed between said top and said bottom and is substantially perpendicular to said top and said bottom, an ice receiving inlet, an airflow inlet located in said sidewall near said bottom and an airflow outlet located in said top;

an ice dispenser disposed on said bottom of said ice storage bin; and an ozone generator that is located outside said ice storage bin, that is in fluid communication with said ice storage bin and that circulates a sanitizing agent through said ice storage bin via said airflow inlet and said airflow outlet, wherein said airflow inlet directs a flow of said sanitizing agent from said bottom to said top of said ice storage bin to purge and replace non-ozone air within said ice storage bin with said sanitizing agent and wherein said sanitizing agent comprises a mixture of ozone and ambient air that sanitizes one or more interior surfaces of said ice storage bin, of said ice dispenser and of any ice disposed within said ice storage bin.

2. The sanitation system of claim 1, further comprising a supply duct that connects said ozone generator to said airflow inlet and a return duct that connects said airflow outlet to said ozone generator, and wherein said sanitizing agent circulates through said ice storage bin via said supply duct and said return duct so that substantially all interior surfaces of said ice storage bin are exposed to said sanitizing agent.

3. The sanitation system of claim 2, further comprising:

a mixing Tee having an outlet connected to said ozone generator, a first inlet connected to said return duct and a second inlet connected to ambient air; and first and second orifices associated with said first and second inlets, respectively, and wherein said orifices are sized to control flow rates in said first and second inlets so as to develop a positive pressure level within said ice storage bin.

4. The sanitation system of claim 3, further comprising:

a nozzle of said ice dispenser disposed to dispense ice via an ice exit of said ice storage bin; and a vent disposed in said ice storage bin to allow a small portion of said sanitizing agent to flow through a gap to sanitize surfaces of said ice dispenser and of said ice exit.

5. The sanitation system of claim 4, further comprising one or more seals disposed to prevent leakage of said sanitizing agent from said ice storage bin except for said vent.

6. The sanitation system of claim 1, further comprising an ice making machine that provides ice to said ice receiving inlet.

7. The sanitation system of claim 1, wherein a velocity of the sanitizing agent within said ice storage bin is maintained low, thereby allowing laminar displacement of all ambient air from said ice storage bin.

8. A method of sanitizing ice storage and dispensing equipment that includes an ice storage bin comprising a top, a bottom and at least one sidewall, wherein said top is a surface disposed in substantially parallel relationship to said bottom and wherein said sidewall is disposed between said top and said bottom and is substantially perpendicular to said top and said bottom, said method comprising:

providing an ice dispenser on said bottom of said ice storage bin;

circulating a sanitizing agent through said ice storage bin, wherein said sanitizing agent comprises a mixture of ozone and ambient air that sanitizes one or more interior surfaces of said ice storage bin and of said ice dispenser; and directing a flow of said sanitizing agent from an inlet in said sidewall near said bottom to an outlet in said top of said ice storage bin to purge and replace non-ozone air within said ice storage bin with said sanitizing agent.

9. The method of claim 8, further comprising:

developing a positive pressure within said ice storage bin; and directing a small portion of said flow of said sanitizing agent through a vent to sanitize ice dispensing components of said ice dispenser that dispenses ice from said ice storage bin.

10. The method of claim 8, wherein said flow of said sanitizing agent comprises a laminar flow of ozone containing air.

11. The method of claim 8, further comprising:

disposing one or more seals to prevent leakage of said sanitizing agent from said ice storage bin.

12. The method of claim 8,further comprising:

maintaining a low velocity of the sanitizing agent within said ice storage bin, thereby allowing laminar displacement of all ambient air from said ice storage bin.

13. A method of assembling ice storage equipment comprising:

providing an ozone generator comprising an input and an output;

providing an ice storage bin comprising a top, a sidewall and a bottom, wherein said top is a surface disposed in substantially parallel relationship to said bottom and wherein said sidewall is disposed between said top and said bottom and is substantially perpendicular to said top and said bottom providing an ice dispenser on said bottom of said ice storage bin;

providing an inlet in said sidewall and an outlet in said top of said ice storage bin;

providing a mixing tee comprising an output, a first input and a second input;

connecting said output of said ozone generator to said inlet of said ice storage bin with a first duct;

connecting said output of said mixing Tee to said input of said ozone generator;

connecting said outlet of said ice storage bin to said first input of said mixing Tee; and connecting said second input of said mixing Tee to ambient air.

* * * * *